US012416178B1

(12) United States Patent
Goedecke

(10) Patent No.: US 12,416,178 B1
(45) Date of Patent: Sep. 16, 2025

(54) FENCE SYSTEM AND METHOD, AND BLOCK Z FENCE POST ASSEMBLY THEREFOR

(71) Applicant: Bullet Fence Systems, LLC, Okmulgee, OK (US)

(72) Inventor: Ronald D. Goedecke, Okmulgee, OK (US)

(73) Assignee: Bullet Fence Systems, LLC, Okmulgee, OK (US)

( * ) Notice: Subject to any disclaimer, the term of this patent is extended or adjusted under 35 U.S.C. 154(b) by 0 days.

(21) Appl. No.: 19/184,416

(22) Filed: Apr. 21, 2025

(51) Int. Cl.
*E04H 17/20* (2006.01)
*E04H 17/14* (2006.01)

(52) U.S. Cl.
CPC ..... *E04H 17/20* (2013.01); *E04H 17/1456* (2021.01)

(58) Field of Classification Search
CPC . E04H 17/14; E04H 17/1447; E04H 17/1452; E04H 17/1456; E04H 17/20
See application file for complete search history.

(56) References Cited

U.S. PATENT DOCUMENTS

| | | | | |
|---|---|---|---|---|
| 1,310,380 | A | 7/1919 | Whittingham | |
| 1,631,820 | A | 6/1927 | Jackson | |
| 2,150,291 | A | 3/1939 | Paque | |
| 2,764,438 | A | 9/1956 | Haviland | |
| 3,092,407 | A | 6/1963 | Blonder | |
| 3,285,576 | A | 11/1966 | Clark | |
| 3,442,110 | A | 5/1969 | Walton et al. | |
| 5,297,890 | A | 3/1994 | Commins | |
| 5,961,242 | A | 10/1999 | Leone | |
| 6,386,519 | B1 | 5/2002 | Priefert | |
| 6,530,561 | B2 | 3/2003 | Larsen et al. | |
| 7,497,640 | B2 * | 3/2009 | Sharp | E01F 15/0461 404/9 |
| 7,571,897 | B2 | 8/2009 | Heinz | |
| 8,858,112 | B2 * | 10/2014 | Wallace | E01F 13/12 404/9 |
| 8,914,660 | B2 | 12/2014 | Tanaka | |
| D783,181 | S * | 4/2017 | Coulston | D25/126 |
| 9,631,331 | B2 * | 4/2017 | Colquhoun | E04H 12/2215 |
| 10,676,958 | B2 | 6/2020 | Short et al. | |
| 10,760,298 | B2 | 9/2020 | Crandall et al. | |
| 11,408,196 | B2 * | 8/2022 | Cogburn | E04H 17/1447 |

(Continued)

FOREIGN PATENT DOCUMENTS

| | | |
|---|---|---|
| FR | 2896282 | 7/2007 |
| FR | 3142208 | 5/2024 |

(Continued)

OTHER PUBLICATIONS

Master Halco—Postmaster Fence System—Installation Guidline Sheets; www.masterhalco.com.
Why Z Post? www.metalfencepost.com.

*Primary Examiner* — Jonathan P Masinick
(74) *Attorney, Agent, or Firm* — Dennis D. Brown; Brown Patent Law, P.L.L.C.

(57) ABSTRACT

A fence system and method using metal fence posts which are each assembled by attaching two elongate pieces having block Z cross-sectional shapes to form offset, longitudinally extending channels, on opposite sides of the posts, for receiving the end portions of a series of segments of fence filler material which extend between the posts.

18 Claims, 6 Drawing Sheets

(56) References Cited

U.S. PATENT DOCUMENTS

| | | | | |
|---|---|---|---|---|
| 11,578,502 | B2 | 2/2023 | Naylor | |
| 2016/0145893 | A1 | 5/2016 | Coulston et al. | |
| 2022/0316234 | A1* | 10/2022 | Cogburn | E04H 17/20 |

FOREIGN PATENT DOCUMENTS

| | | | | |
|---|---|---|---|---|
| GB | 2116597 | | 3/1983 | |
| GB | 2199601 | | 2/1988 | |
| GB | 2289073 | | 11/1995 | |
| GB | 2300435 | | 6/1996 | |
| GB | 2312005 | A * | 10/1997 | E04H 17/20 |
| GB | 2426526 | | 11/2006 | |
| GB | 2570912 | | 8/2019 | |

* cited by examiner

FENCE SYSTEM AND METHOD, AND BLOCK Z FENCE POST ASSEMBLY THEREFOR

FIELD OF THE INVENTION

The present invention relates to fence systems and methods, and to fence post assemblies for fence systems.

BACKGROUND OF THE INVENTION

In general, a continuing need exists for improved fence systems and methods for residential and other uses. The improved fence systems will preferably be lower cost, less complicated, and easier to install. The improved fence systems will also preferably provide: greater strength and durability; improved weather resistance; a better appearance; and/or new options for the design and appearance of the fence system.

In constructing fences for residential and other purposes, various types of fence posts are commonly used in the art. One type of fence post is a metal Z-post which has something of a block Z cross-sectional shape. The block Z shape provides a pair of rail attachment plates which extend along the longitudinal length/height of the post. One of the rail attachment plates extends to the right and the other rail attachment plate extends to the left.

The rail attachment plates of the Z-post lie in parallel vertical planes which are spaced forwardly and rearwardly apart and have apertures formed therethrough for screwing the ends of horizontal wooden fence rails to the rail attachment plates. In this way, a series of Z-posts can be used, for example, for attaching and supporting (i) a continuous end-to-end series of upper horizontal fence rails, (ii) a continuous end-to-end series of lower horizontal fence rails, and/or (iii) a continuous end-to-end series of middle horizontal fence rails. Vertical wooden pickets or slats can then be attached, side-by-side, to the horizontal upper, lower, and middle rails using nails or other attachments. Typically, the rail attachment plates of the Z-posts must also be covered by vertical wooded slats or other covers on one or both sides of the fence.

Z-posts and other metal fence posts of this type are sturdy and weather-resistant. Unfortunately, however, these types of posts have not been well suited for installing various types of fence systems. For example, Z-posts for have not been well-suited for installing horizontal fence filler materials comprising, e.g., vertical series of horizontal boards, planks, or panels.

Consequently, a need exists for an improved fence post system which provides all of the benefits of the prior Z-post system but also allows attractive, horizontal fence filler materials to be quickly and easily installed between the fence posts at a lower cost. A need particularly exists, for example, for an improved fence post system which is well suited for quickly and easily installing horizontal fence filler materials of the type which comprise a vertical series of horizontal boards, planks, or panels.

SUMMARY OF THE INVENTION

The present invention provides a fence system and method, and a fence post assembly therefor, which alleviate the problems and satisfy the needs mentioned above. The inventive fence system and post assembly provide all of the advantages of prior Z-post systems but are also well suited for quickly and easily installing horizontal fence filler materials such as, e.g., a horizontal fence filler comprising a vertical series of horizontal boards, planks, or panels.

The inventive fence system and post assembly also (i) provide an appearance which is better than and/or different from prior fence systems, (ii) allow the use of readily available and lower cost post and fence materials, (iii) are adaptable for alternatively holding screening materials, welded wire panels, and other horizontal filler materials having a wide range of thicknesses (e.g., from as little as 0.5 inch or less to as much as 1.0 inch or more) for the body of the fence, and (iv) allow the post assembly and fence to be installed without welding.

In one aspect, there is provided a fence post which preferably comprises an elongate first piece having a block Z cross-sectional shape and an elongate second piece having a block Z cross-sectional shape. Each of the elongate first and second pieces preferably comprises: (i) a longitudinally extending center plate portion having a longitudinal axis, a longitudinally extending first outer edge, and a longitudinally extending second outer edge opposite the first outer edge, (ii) a longitudinally extending first flange plate which extends along and projects laterally outward in a first direction from the first outer edge of the center plate portion at substantially a 90° angle, and (iii) a longitudinally extending second flange plate which extends along and projects laterally outward in a second direction, opposite the first direction, from the second outer edge of the center plate portion at substantially a 90° angle.

The center plate portion of the second piece is preferably connected to the center plate portion of the first piece to form (i) a longitudinally extending first channel, between the first flange plate of the first piece and the first flange plate of the second piece, for receiving a first fence filler material and (ii) a longitudinally extending second channel, between the second flange plate of the first piece and the second flange plate of the second piece, for receiving a second fence filler material which can be the same as or different from the first fence filler material.

In another aspect, there is a provided a fence which preferably comprises: a fence post of the type described above; a first fence filler material having an end portion or a series of end portions which is/are received in the first channel of the fence post; and a second fence filler material having an end portion or a series of end portions which is/are received in the second channel of the fence post, wherein the second fence filler material can be the same as, or different from, the first fence filler material.

In another aspect, the second piece of the fence post can have a longitudinal length which is less than a longitudinal length of the first piece such that the first piece includes, but the second piece does not include, an anchoring end portion which extends into a ground surface.

Further objects, features, and advantages of the present invention will be apparent to those in the art upon reviewing the accompanying drawings and upon reading the following Detailed Description of the Preferred Embodiments.

DETAILED DESCRIPTION OF THE PREFERRED EMBODIMENTS

Figure 1:
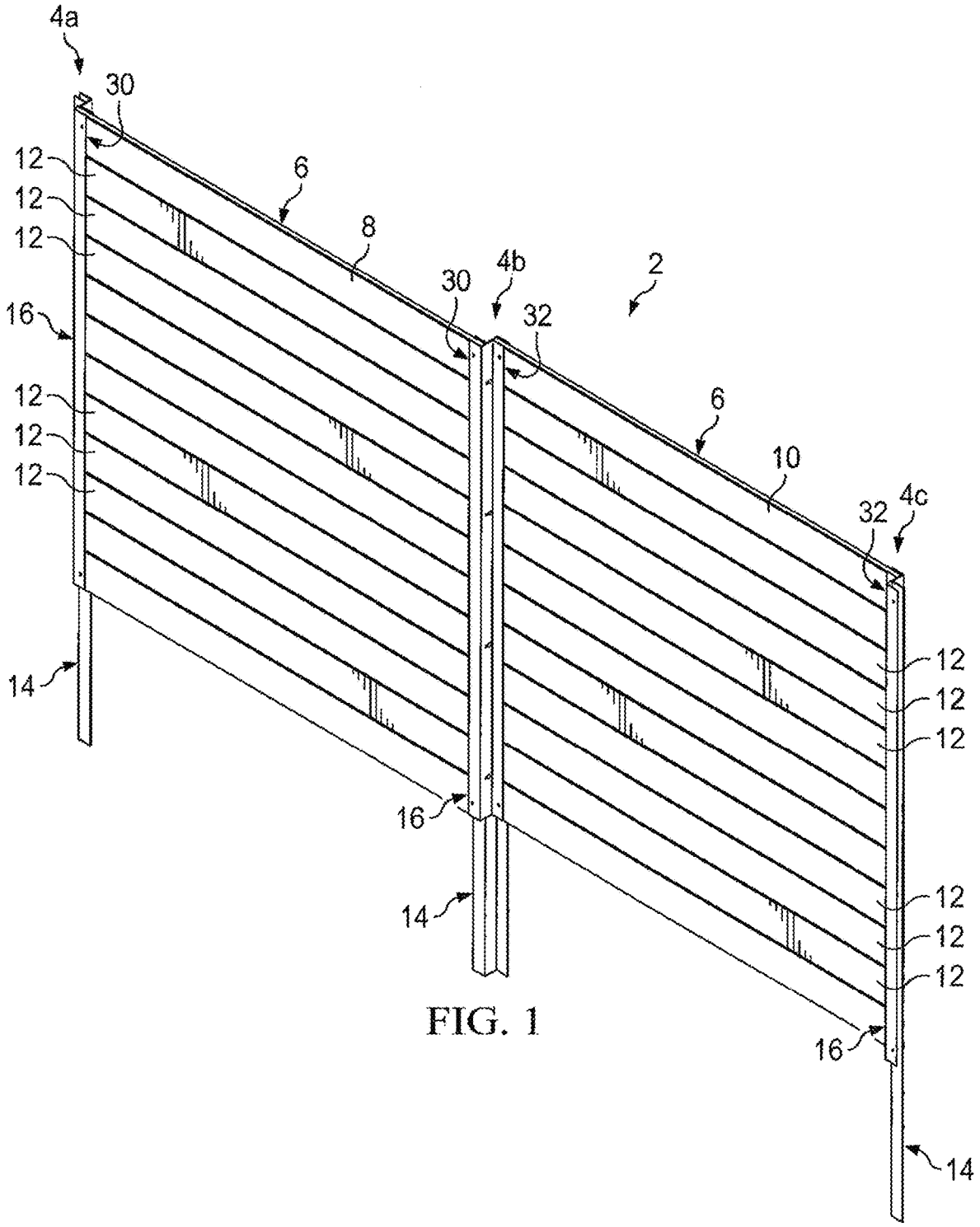
FIG. 1 is a perspective view of an embodiment 2 of the fence system provided by the present invention.

An embodiment 2 of the inventive fence system is illustrated in FIGS. 1-8. The inventive fence system 2 preferably comprises: (a) a series of inventive vertical fence post assemblies 4 (shown as a sequence of the post assemblies 4*a*, 4*b*, 4*c*) and (*b*) a series of segments 8 and 10 of fence filler material 6 which are held by and extend horizontally between the fence post assemblies 4. The lower ends of the fence posts 4*a*, 4*b*, 4*c* can be driven into and/or cemented in the ground 5.

As used herein and in the claims, unless otherwise stated, the term "horizontal" when used in reference to the fence filler material 6, or to the inventive fence system 2 or the features thereof in general, includes both (i) a substantially non-angled horizontal orientation (i.e., ±10°) or (ii) a horizontal orientation which is otherwise angled to a degree needed to adapt to the slope of the terrain.

The fence filler material 6 used in the inventive fence system 2 can be generally any type of fencing material used in the art to provide the body of the fence 2 which fills the horizontal segments between the fence posts 4*a*, 4*b*, 4*c*. Moreover, because of the adjustability of the widths of the longitudinally extending first and second channels 30 and 32 (discussed below) of the fence post assemblies 4 for receiving and holding, or clamping, the filler materials 6, the thickness of the filler material 6 can range from 0.4 inch or less to 0.75 inch or more (more preferably from 0.5 inch or less up to 0.8 inch or 0.85 inch or 0.9 inch or 0.95 inch or 1.0 inch or more).

By way of example, but not by way of limitation, examples of fence filler materials 6 preferred for use in the inventive fence system 2 include (i) a vertical series of horizontal boards, planks, or panels 12, (ii) a woven fence or other screening material, or (iii) welded wire panels. If the segment 8 or 10 of fence filler material 6 is a vertical series of horizontal boards, planks, or panels 12 positioned one on top of the other, the boards, planks, or panels 12 can be (i) closely grouped together such that there are essentially no gaps between the horizontal boards, planks, or panels 12 or (i) spaced apart to produce a vertical series of horizontal gaps between the horizontal boards, planks, or panels 12.

Each of the inventive fence post assemblies 4 (i.e., 4*a*, 4*b*, 4*c*) illustrated in FIGS. 1-8 preferably comprises: (i) an elongate, vertically-extending first piece 14 having a block Z cross-sectional shape and (ii) an elongate, vertically-extending second piece 16 having a block Z cross-sectional shape.

Because of their block Z cross-sectional shapes as illustrated in the drawings, each of first elongate piece 14 of the post 4 and the second elongate piece 16 of the post 4 comprises: (a) a flat, longitudinally extending center plate portion 18; (b) a flat, longitudinally extending first flange plate 26; and (c) a flat, longitudinally extending second flange plate 28.

The center plate portion 18 of each of the first and second elongate pieces 14 and 16 of the post 4 has a longitudinal axis 20, a longitudinally extending first outer edge 22, and a longitudinally extending second outer edge opposite 24 the first outer edge 22. The first flange plate 26 of each of the first and second elongate pieces 14 and 16 extends along and projects laterally outward in a first direction from the first outer edge 22 of the center plate portion 18 at substantially a 90° angle (i.e., 90°±5°). The second flange plate 28 of each of the first and second elongate pieces 14 and 16 extends along and projects laterally outward in a second direction, opposite the first direction, from the second outer edge 24 of the center plate portion 18 at substantially a 90° angle. Most preferably, the first flange plate 26 of each post member 14 and 16 lies in a first plane, the second flange plate 28 lies in a second plane which is offset from the first plane, and the second plane is parallel to the first plane.

In the inventive fence post assembly 4, the center plate portion 18 of the second elongate piece 16 of the post 4 is positioned against and connected to the center plate portion 18 of the first elongate piece 14 to form (i) a longitudinally extending first channel 30, between the first flange plate 26 of the first piece 14 and the first flange plate 26 of the second piece 16, for receiving an end portion (or a series of end portions in the case of, e.g., a vertical series of horizontal boards, planks, or panels 12) of a first horizontal segment 8 of fence filler material 6 and (ii) a longitudinally extending second channel 32, between the second flange plate 28 of the first piece 14 and the second flange plate 28 of the second piece 16, for receiving an end portion (or a series of end portions in the case of, e.g., a vertical series of horizontal boards, planks, or panels 12) of a second horizontal segment 10 of fence filler material 6 which may be the same as, or different from, the first segment 8 of fence filler material 6.

When the second elongate piece 16 of the post 4 is connected to the first elongate piece 14 in this manner, the first flange plate 26 of the first piece 14 will preferably be parallel to the first flange plate 26 of the second piece 14 and the second flange plate 28 of the first piece 14 will preferably be parallel to the second flange plate 28 of the second piece 16. In addition, the longitudinally extending first and second channels 30 and 32 of the inventive fence post 4 are forwardly and rearwardly offset from each other so that each succeeding horizontal segment 8 or 10 of fence filler material 6 will be forwardly or rearwardly offset from the previous segment 8 or 10 of fence filler material 6.

The longitudinally extending first and second channels 30 and 32 of the inventive fence post 4 preferably have a width which is adjustable for receiving and holding filler materials of different thicknesses. To provide for the simultaneous adjustment of the width of the first channel 30 and the second channel 32, the inventive fence post assembly 4 preferably further comprises: (i) a longitudinal series of bolt holes 38 formed through the center plate portion 18 of the first elongate piece 14 of the post 4; (ii) a longitudinal series of corresponding lateral slots 40 formed through the center plate portion 18 of the second elongate piece 16 which align with the bolt holes 38; (iii) a series of bolts 42 which extend through the aligned bolt holes 38 and lateral slots 40; and (iv) nuts 44 for securing the bolts 42 in the lateral slots 40 to set the desired width of the first and second channels 30 and 32 of the post 4.

The distance over which the width of the first and second channels 30 and 32 of the post 4 can be adjusted depends upon the length of the lateral slots 40. In order to (a) provide a sufficient minimum width of the first and second channels 30 and 32 for receiving a filler material 6 and (b) allow the formation of lateral adjustment slots 40 of sufficient length to permit the width of the first and second channels 30 and 32 to be increased over a desired range, the width 46 of the center plate portion 18 of each of the first and second pieces 14 of the inventive post 4 will preferably be greater than the corresponding width of a typical one-piece metal Z-post which is currently available in the market.

The length of the lateral slots 40 formed in the second elongate piece 16 of the inventive post 4 will preferably be sufficient to allow the width of the first and second channels 30 and 32 to be adjusted from a minimum width that is equal to or less than ⅝ inch to a maximum width that is equal to or greater than ¾ inch. The length of the lateral slots 40 formed in second elongate piece 16 of the post 4 will more preferably be sufficient to allow the width of the first and second channels 30 and 32 to be adjusted from a minimum width that is equal to or less than ½ inch to a maximum width that is equal to or greater than ⅞ inch.

It will be understood, however, that (i) the elongate first and second pieces 14 and 16 of the inventive fence post 4 can alternatively be adjustably attached using other techniques or (ii) the elongate first and second pieces 14 and 16 of the post 4 can alternatively be permanently attached, e.g., by welding, such that the width of the elongate first and second channels 30 and 32 of the inventive post 4 for receiving the filler material 6 is not adjustable.

The longitudinal length of the second elongate piece 16 of the inventive fence post assembly 4 can be the same as or different from the length of the first piece 14. More preferably, the longitudinal length of one of the first or second elongate pieces 14 or 16 (e.g., the second piece 16) will be less than the longitudinal length of the other elongate piece 14 or 16 (e.g., the first piece 14) such that the longer piece 14 or 16 includes, but the shorter piece 14 or 15 does not include, a lower anchoring segment which extends into the ground surface 5. Consequently, the shorter piece 14 or 16 of the post 4 will preferably only extend along all or a portion of the above-ground height of the inventive fence post 4 so that the shorter piece 14 or 16 preferably does not extend into the ground 5, or preferably at least does not extend into the ground 5 to any significant length.

If desired, some, most, or all of the end portions of the vertical series of horizontal boards, planks, or panels 12 of the segments 8 and 10 of the filler material 6 can simply be rest in the first and second channels 30 and 30 of the inventive post 4 without further attachment. Alternatively, in order to further secure the ends or the vertical series of ends of the filler material 6 in the post channels 30 and 32, the inventive fence post assembly 4 can further comprise: (a) a plurality of screws 48 which extend through apertures provided in the first flange plate 26 of the first piece 14 of the post 4 and/or through the first flange plate 26 of the second piece 16 of the post 4 into the end portion or the series of end portions 50 of the horizontal segment 8 of the fence filler material 6 and (b) a plurality of screws 52 which extend through apertures provided in the second flange plate 28 of the first piece 16 of the post 4 and/or through the second flange plate 28 of the second piece 16 of the post 4 into the end portion or the series of end portions 54 of the horizontal segment 10 of the fence filler material 6.

Figure 2:
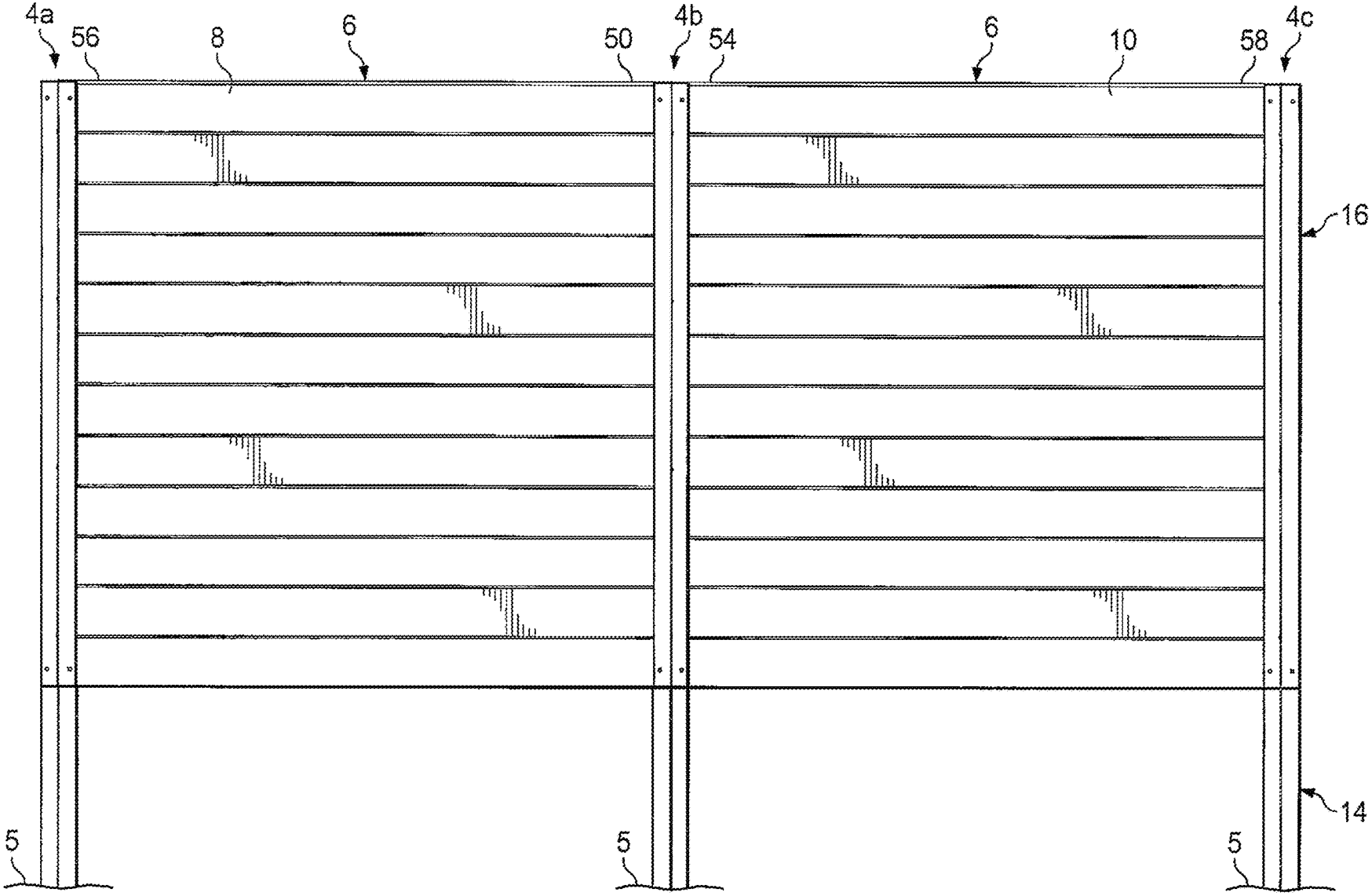
FIG. 2 is a front elevational view of the inventive fence system 2.
Figure 3:
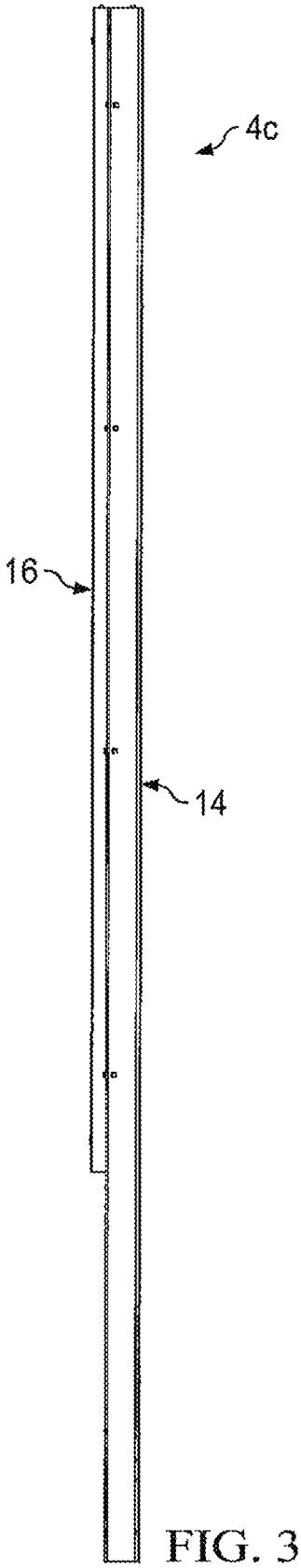
FIG. 3 is an elevational end view of the inventive fence system 2.
Figure 4:
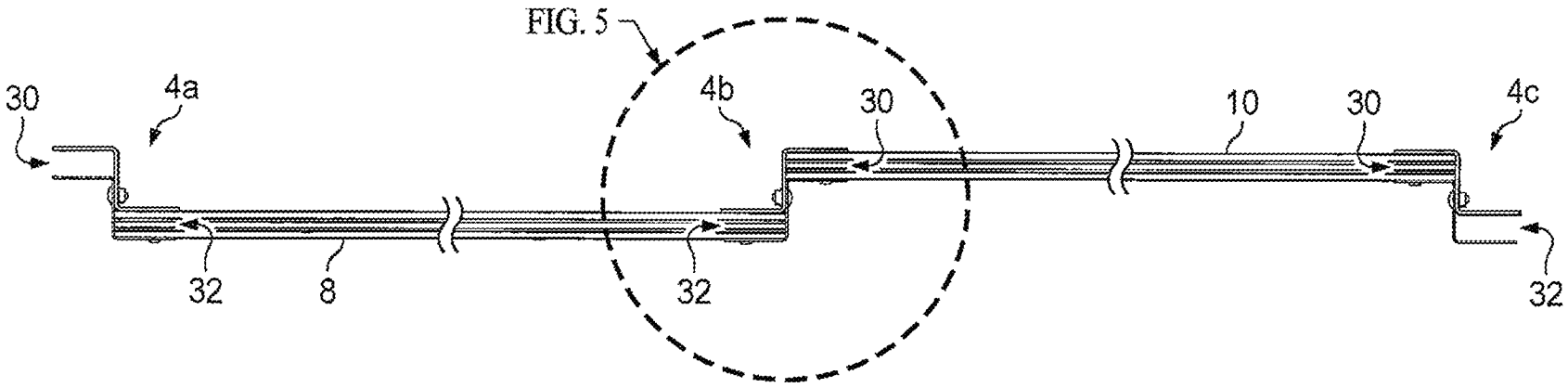
FIG. 4 is top view of the inventive fence system 2.
Figure 6:
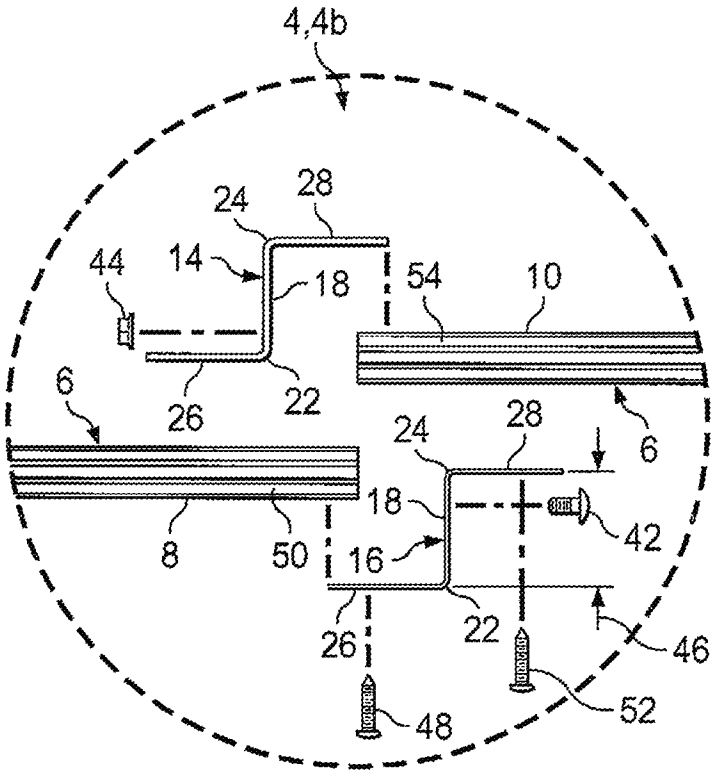
FIG. 6 is an exploded top view of the inventive fence post assembly 4.
Figure 5:
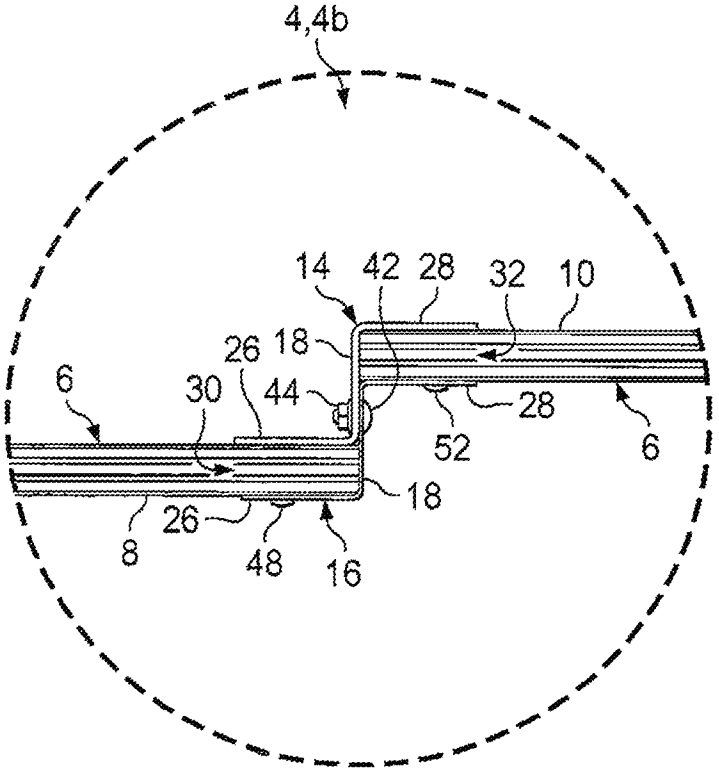
FIG. 5, which is an enlargement of section 5-5 shown in FIG. 4, is a top view of an embodiment 4 of the fence post assembly provided by the present invention.
Figure 8:
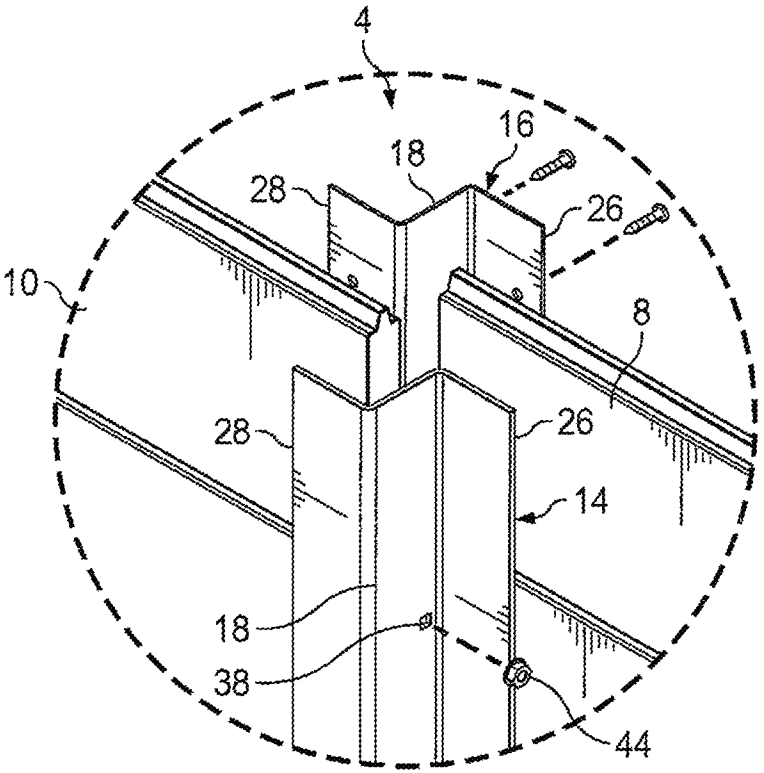
FIG. 8 is an exploded back perspective view of the inventive fence post assembly 4.
Figure 7:
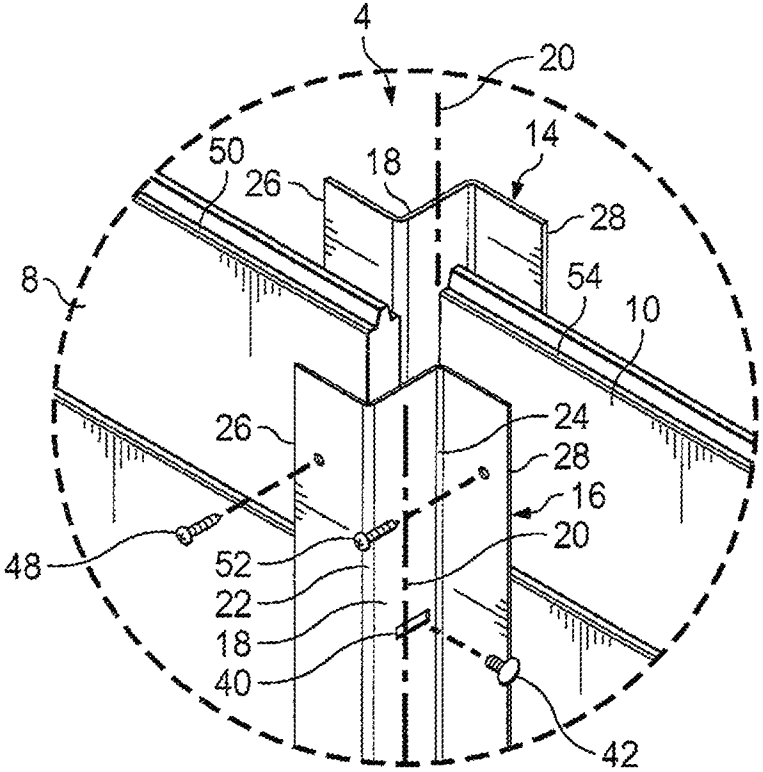
FIG. 7 is an exploded front perspective view of the inventive fence post assembly 4.

In the embodiment illustrated in FIGS. 1 and 2, the inventive fence system 2 comprises: (i) three inventive fence posts 4 (i.e., fence posts 4*a*, 4*b*, 4*c*) of identical construction; (ii) the above-mentioned horizontal segment 8 of fence filler material 6 which extends between the inventive posts 4*a* and 4*b*; and (iii) the above-mentioned horizontal segment 10 of fence filler material 6 which extends between the inventive posts 4*b* and 4*c*. In this arrangement as shown, the end portion or the series of end portions 50 of the horizontal segment 8 of the fence filler material 6 is/are received in the first channel 30 of the inventive fence post 4*b* whereas the opposite end portion or series of end portions 56 of the horizontal filler segment 8 is/are received in the second channel 32 of the inventive fence post 4*a*. Similarly, the end portion or the series of end portions 54 of the horizontal filler segment 10 is/are received in the second channel 32 of the inventive fence post 4*b* whereas the opposite end portion or series of end portions 58 of the horizontal filler segment 10 is/are received in the first channel 32 of the inventive fence post 4*c*.

Although a series of three identical inventive fence posts 4*a*, 4*b*, and 4*c* is shown in FIGS. 1 and 2, it will be understood that the inventive fence system 2 can comprise any desired number of the inventive posts 4 having segments of any desired fence material 6 extending therebetween.

It will also be understood that, if desired, the inventive fence 2 can further include any other components and features which are commonly used in fence systems. For example, planks, panels, or other covers can optionally be secured over any exposed first and/or second flange plates 26 and 28 of the inventive post 4 on either or both sides of the inventive fence 2.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and as set forth in the claims.

What is claimed is:

1. A fence post comprising:

an elongate first piece;

an elongate second piece;

each of the first and the second pieces having a block Z cross-sectional shape such that each of the first and the second pieces comprises a longitudinally extending center plate portion having a longitudinal axis, a longitudinally extending first outer edge, and a longitudinally extending second outer edge opposite the first outer edge, a longitudinally extending first flange plate which extends along and projects laterally outward in a first direction from the first outer edge of the center plate portion at substantially a 90° angle, and a longitudinally extending second flange plate which extends along and projects laterally outward in a second direction, opposite the first direction, from the second outer edge of the center plate portion at substantially a 90° angle; and the center plate portion of the second piece of the fence post being connected to the center plate portion of the first piece of the fence post to form (i) a longitudinally extending first channel, between the first flange plate of the first piece and the first flange plate of the second piece, for receiving a first fence filler material and (ii) a longitudinally extending second channel, between the second flange plate of the first piece and the second flange plate of the second piece, for receiving a second fence filler material which is identical to or different from the first fence filler material.

2. The fence post of claim 1 further comprising:

the first flange plate of the first piece being parallel to the first flange plate of the second piece and the second flange plate of the first piece being parallel to the second flange plate of the second piece.

3. The fence post of claim 1 further comprising:

the center plate portion of the first piece having a longitudinal series of bolt holes therethrough;

the center plate portion of the second piece having a longitudinal series of corresponding lateral slots therethrough for adjusting (i) a width of the longitudinally extending first channel between the first flange plate of the first piece and the first flange plate of the second piece and (ii) a width of the longitudinally extending second channel between the second flange plate of the first piece and the second flange plate of the second piece; and the center plate portion of the second piece being adjustably connected to the center plate portion of the first piece by bolts which extend through the bolt holes of the first piece and the corresponding lateral slots of the second piece.

4. The fence post of claim 3 further comprising the lateral slots of the second piece having a length which is sufficient to adjust the width of each of the first and second channels from a minimum width of ⅝ inch or less to a maximum width of ¾ inch or more, the width of the first channel being a distance from the first flange plate of the first piece to the first flange plate of the second piece and the width of the second channel being a distance from the second flange plate of the first piece to the second flange plate of the second piece.

5. The fence post of claim 1 further comprising for each of the first and the second pieces of the fence post:

the first flange plate lying in a first plane;

the second flange plate lying in a second plane; and the second plane being parallel to the first plane.

6. The fence post of claim 1 further comprising the second piece having a longitudinal length which is less than a longitudinal length of the first piece such that the first piece includes, but the second piece does not include, an anchoring end portion which extends into a ground surface.

7. A fence comprising:

a fence post comprising an elongate first piece, an elongate second piece, each of the first and the second pieces having a block Z cross-sectional shape such that each of the first and the second pieces comprises a longitudinally extending center plate portion having a longitudinal axis, a longitudinally extending first outer edge, and a longitudinally extending second outer edge opposite the first outer edge, a longitudinally extending first flange plate which extends along and projects laterally outward in a first direction from the first outer edge of the center plate portion at substantially a 90° angle, and a longitudinally extending second flange plate which extends along and projects laterally outward in a second direction, opposite the first direction, from the second outer edge of the of the center plate portion at substantially a 90° angle, and the center plate portion of the second piece of the fence post being connected to the center plate portion of the first piece of the fence post to form (i) a longitudinally extending first channel between the first flange plate of the first piece and the first flange plate of the second piece and (ii) a longitudinally extending second channel between the second flange plate of the first piece and the second flange plate of the second piece;

a first fence filler material having an end portion or a series of end portions which is/are received in the first channel; and a second fence filler material having an end portion or a series of end portions which is/are received in the second channel, the second fence filler material being identical to, or different from, the first fence filler material.

8. The fence of claim 7 further comprising:

the first fence filler material comprising a vertical series of horizontal boards, planks, or panels and the second fence filler material comprising a vertical series of horizontal boards, planks, or panels.

9. The fence of claim 7 further comprising for each of the first and the second pieces of the fence post:

the first flange plate lying in a first plane;

the second flange plate lying in a second plane; and the second plane being parallel to the first plane.

10. The fence of claim 9 further comprising:

the first flange plate of the first piece being parallel to the first flange plate of the second piece and the second flange plate of the first piece being parallel to the second flange plate of the second piece.

11. The fence of claim 7 further comprising:

the center plate portion of the first piece of the fence post having a longitudinal series of bolt holes therethrough;

the center plate portion of the second piece of the fence post having a longitudinal series of corresponding lateral slots therethrough for adjusting (i) a width of the longitudinally extending first channel between the first flange plate of the first piece and the first flange plate of the second piece and (ii) a width of the longitudinally extending second channel between the second flange plate of the first piece and the second flange plate of the second piece; and the center plate portion of the second piece being adjustably connected to the center plate portion of the first piece by bolts which extend through the bolt holes of the first piece and the corresponding lateral slots of the second piece.

12. The fence of claim 11 further comprising the lateral slots of the second piece having a length which is sufficient to adjust the width of each of the first and second channels from a minimum width of ⅝ inch or less to a maximum width of ¾ inch or more.

13. The fence of claim 7 further comprising:

a plurality of screws which extend through the first flange plate of the first piece and/or the first flange plate of the second piece into the end portion or the series of end portions of the first fence filler material and a plurality of screws which extend through the second flange plate of the first piece and/or the second flange plate of the second piece into the end portion or the series of end portions of the second fence filler material.

14. The fence of claim 7 further comprising the second piece of the fence post having a longitudinal length which is less than a longitudinal length of the first piece of the fence post such that the first piece includes, but the second piece does not include, an anchoring end portion which extends into a ground surface.

15. The fence of claim 7 further comprising:

the fence post being a first fence post;

a second fence post which is identical to the first fence post and includes a first piece, a second piece, a longitudinally extending first channel, and a longitudinally extending second channel which are identical to the first piece, the second piece, the longitudinally extending first channel, and the longitudinally extending second channel of the first fence post;

the end portion or the series of end portions of the first fence filler material being a first end portion or a first series of end portions of the first fence filler material; and the first fence filler material further comprising a second end portion or a second series of end portions, opposite the first end portion or the first series of end portions of the first fence filler material, which is/are received in the second channel of the second fence post.

16. The fence of claim 15 further comprising, for each of the first fence post and the second fence post, the second piece having a longitudinal length which is less than a longitudinal length of the first piece such that the first piece includes, but the second piece does not include, an anchoring end portion which extends into a ground surface.

17. The fence of claim 15 further comprising:

a third fence post which is identical to the first fence post and includes a first piece, a second piece, a longitudinally extending first channel, and a longitudinally extending second channel which are identical to the first piece, the second piece, the longitudinally extending first channel, and the longitudinally extending second channel of the first fence post;

the end portion or the series of end portions of the second fence filler material being a second end portion or a second series of end portions of the second fence filler material; and the second fence filler material further comprising a first end portion or a first series of end portions, opposite the second end portion or the second series of end portions of the second fence filler material, which is/are received in the first channel of the third fence post.

18. The fence of claim 15 further comprising, for each of the first fence post, the second fence post, and the third fence post, the second piece having a longitudinal length which is less than a longitudinal length of the first piece such that the first piece includes, but the second piece does not include, an anchoring end portion which extends into a ground surface.

* * * * *